US007557721B2

(12) United States Patent
Chaniot

(10) Patent No.: US 7,557,721 B2
(45) Date of Patent: Jul. 7, 2009

(54) ON-BOARD THERMOSTAT AND A SYSTEM FOR DETECTING EXCESS TEMPERATURE

(75) Inventor: Daniel Chaniot, Marignane (FR)

(73) Assignee: Eurocopter, Marignane (FR)

( * ) Notice: Subject to any disclaimer, the term of this patent is extended or adjusted under 35 U.S.C. 154(b) by 450 days.

(21) Appl. No.: 11/604,725

(22) Filed: Nov. 28, 2006

(65) Prior Publication Data

US 2007/0119361 A1 May 31, 2007

(30) Foreign Application Priority Data

Nov. 29, 2005 (FR) ..... 05 12056

(51) Int. Cl.
*G08B 17/00* (2006.01)

(52) U.S. Cl. ..... 340/584; 340/508; 340/628; 340/524; 340/691.1; 340/592; 374/100; 374/188; 374/205

(58) Field of Classification Search ..... 340/584, 340/508, 592, 691.1, 524, 628; 374/100, 374/188, 205; 116/101
See application file for complete search history.

(56) References Cited

U.S. PATENT DOCUMENTS 3,099,825 A * 7/1963 Harriman ..... 340/508

FOREIGN PATENT DOCUMENTS

GB 340383 * 1/1931

* cited by examiner

*Primary Examiner*—Benjamin C Lee
*Assistant Examiner*—Sisay Yacob
(74) *Attorney, Agent, or Firm*—Young & Thompson

(57) ABSTRACT

The thermal detection and visual alarm unit includes a plurality of first expansion thermal detectors (17) with normally closed contacts that are connected in series with a first lamp (15) to form a first two-terminal circuit (21, 23), a plurality of second expansion thermal detectors (18) with normally open contacts connected in parallel, a second lamp (16) connected in series with the second thermal detectors to form a second two-terminal circuit (22, 24), the first and second thermal detectors forming a plurality of cells (19) each combining a first detector and a second detector having respective contact-opening or contact-closing temperatures that are substantially equal, each of the first and second two-terminal circuits being arranged for connection to the terminals of an electrical power supply (12).

12 Claims, 3 Drawing Sheets

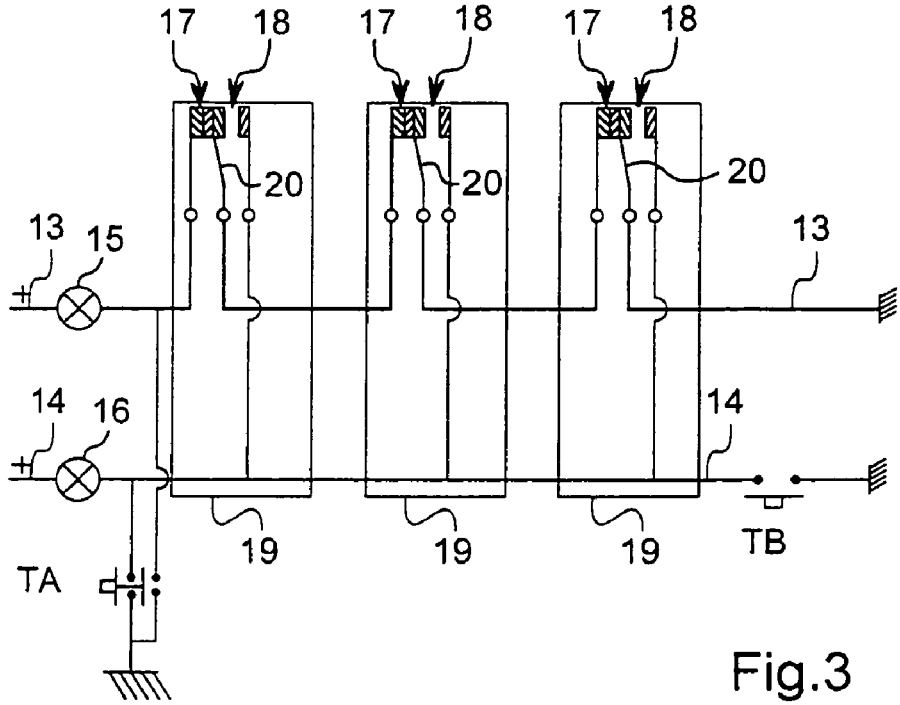
Fig.3
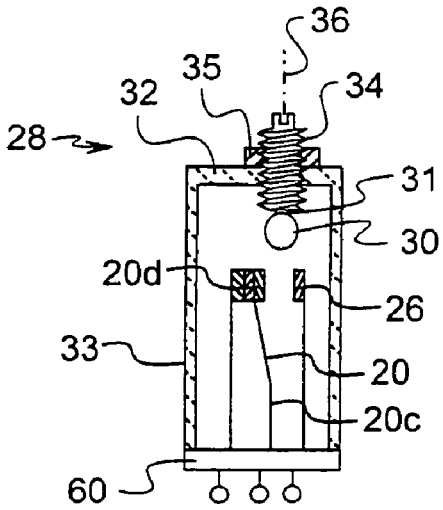
Fig.4
Fig.5
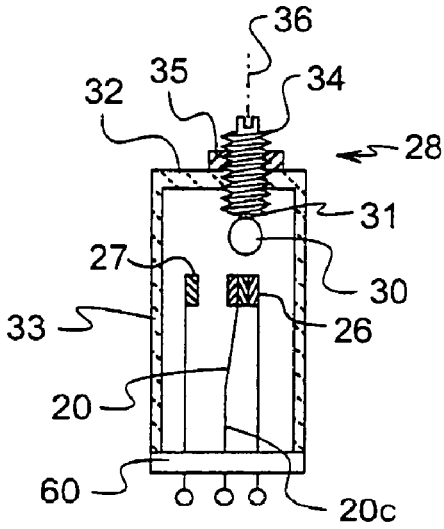

ON-BOARD THERMOSTAT AND A SYSTEM FOR DETECTING EXCESS TEMPERATURE

The present invention relates to a thermostat and to a system for detecting excess temperature.

FIELD OF THE INVENTION

The technical field of the invention is that of manufacturing systems for detecting fire on board an aircraft.

The present invention relates more particularly to improvements provided to a bimetallic thermostat with a changeover contact for an aircraft, and also to a simple system for detecting excess temperature, the system incorporating a plurality of such thermostats.

BACKGROUND OF THE INVENTION

It is known to detect excess temperature or fire using a bimetallic thermostat placed in a zone of an aircraft that is to be monitored, for example in its propulsion engine or in a transmission gearbox of a rotary wing aircraft. A resistor may be provided across the contact terminals that are opened or closed by the bimetallic strip.

In order to monitor a plurality of distinct zones, it is possible to connect in series a plurality of thermostats having contacts that are normally closed (NC); it is also possible to connect in parallel a plurality of thermostats having contacts that are normally open (NO).

It is also known to use detectors with changeover contacts combining a contact that is normally closed and a contact that is normally open.

British patent No. 1 343 819 describes a multi-zone fire detection loop comprising a plurality of detection units and a terminal resistor; each detection unit has a series fault NC contact and a short-circuit fault NO contact; in the event of a fire, closure of an NO contact short-circuits the terminal resistor, reducing the impedance of the loop and activating a loop relay; this activation is held by a holding contact controlled by the relay, so long as a switch for turning off the power supply to the loop is not actuated.

The loop also has a transistor acting in the absence of an alarm to pass sufficient current in the loop to power a second relay indicative of good operation; if the loop is opened, deactivation of the second relay serves to warn of the fault.

In order to avoid a fault detection unit "hiding" an alarm detected by another detection unit placed further "downstream" in the loop, a monitoring circuit is also associated with each detection unit; that circuit includes a lamp identifying which detection unit is at fault and serves to keep current flowing in the loop.

Such a detection loop is relatively complex and ill-adapted to monitoring multiple zones on board an aircraft.

Prior art fire detectors, and prior art systems incorporating such detectors, present too great a rate of false alarms, in particular from the NC contact detectors (normally closed).

The reliability of NO detectors is generally less than that of NC detectors, due to corrosion of the contacts of the bimetallic strip.

In order to protect the contacts of such expansion detectors, the bimetallic strip and its contacts can be housed in a sealed housing or compartment; this makes it more complicated to verify proper operation of the detector. When such verification is performed by heating the detector, that can result in changing the "changeover" temperature of the bimetallic contact.

OBJECTS AND SUMMARY OF THE INVENTION

An object of the invention is to propose thermal detectors and detection systems for detecting excessive temperature, that are simple to test and to use.

An object of the invention is to provide such detectors and detection systems having improved reliability.

An object of the invention is to propose such detectors and detection systems that are improved or that remedy, at least in part, the shortcomings or drawbacks of prior art fire detection systems and detectors.

In an aspect of the invention, a thermal detection and visual alarm unit is provided that comprises (and is essentially constituted by):

- a plurality of first expansion thermal detectors with normally closed contacts that are connected in series with a first lamp to form a first two-terminal circuit;
- a plurality of second expansion thermal detectors with normally open contacts that are connected in parallel;
- a second lamp that is connected in series with the second thermal detectors to form a second two-terminal circuit;
- the first and second thermal detectors forming a plurality of cells each combining a first detector and a second detector having respective transition temperatures (for opening or closing a contact) that are matched (substantially equal), each of said first and second two-terminal circuits being arranged to be connected to the terminals of an electrical power supply, such that so long as none of the transition temperatures has been reached, the first lamp is powered by said power supply to indicate proper operation, and as soon as one of the transition temperatures is reached, the second lamp is powered by said power supply to indicate excess temperature or fire.

In other words, and in another aspect of the invention, there is provided a system for detecting fire on board an aircraft, the system comprising:

- an electrical power supply; and
- a plurality of detection cells, each cell being provided in a zone to be monitored of the aircraft and including a first expansion thermal detector with normally closed contacts and a second expansion thermal detector with normally open contacts, the respective changeover temperatures of the first and second detectors in a cell being equal or close, the cells being connected in cascade and forming a monitoring equipotential or line together with a fault line, a lamp being inserted in each of these two lines, the two lines being connected in parallel to the terminals of the electrical power supply.

In another aspect, the invention applies to a cell for detecting transition through a transition temperature, the cell comprising a (bimetallic) deformable strip or structure suitable for deforming by differential expansion and changing over at said transition temperature from a first configuration in which a normally closed contact is closed to a second configuration in which a normally open contact is closed, and in which a normally closed contact is opened, and vice versa; in accordance with an aspect of the invention, the cell further comprises an electrically conductive element that is movable relative to the bimetallic strip or structure, together with a member for placing the movable conductor element in contact with the (bimetallic) deformable strip or structure so as to cause, in said first configuration, the normally open contact to close, thereby making it possible to verify that the cell is properly connected to a power supply without subjecting said cell to said transition temperature.

For the same purpose, and in a variant embodiment of the invention, the cell includes an element bearing against the (bimetallic) deformable strip or structure and a member for causing said strip or structure to be deformed by the bearing element pressing thereagainst, the deformation being sufficient to cause the normally closed contact to open and the normally open contact to close.

In an embodiment, the movable conductor element, or bearing element, is secured to a support that is mounted to move relative to a substantially sealed housing containing the strip or structure that is deformable by differential expansion.

In a particular embodiment, the movable support is urged, by a spring, towards a position in which the conductor element or bearing element is inactive.

In another embodiment, displacement of the movable support is obtained by exciting an electromagnetic circuit.

BRIEF DESCRIPTION OF THE DRAWINGS

Other aspects, characteristics, and advantages of the invention appear in the following description which refers to the accompanying drawings that show, without any limiting character, preferred embodiments of the invention.

In the figures, elements or members that are (functionally) identical or similar are identified by identical references.

FIG. 3 is a diagram showing a third embodiment of a detection unit and system in accordance with the invention.

FIGS. 4 to 9 are diagrammatic section views of preferred embodiments of a detection cell in accordance with the invention.

FIGS. 4 and 5 show respectively a cell in said first configuration of the bimetallic strip, and in the second configuration of said strip.

FIGS. 6, 8, and 9 show two variants of test means for inserting a conductor element between the strip and a normally open contact that are also shown in FIGS. 4 and 5; FIG. 9 is a fragmentary diagrammatic view on a larger scale of the FIG. 8 detector.

FIG. 7 shows a cell incorporating means for pressing against and deforming the bimetallic strip in order to test that the cell is connected to a power supply source.

MORE DETAILED DESCRIPTION

Figure 1:
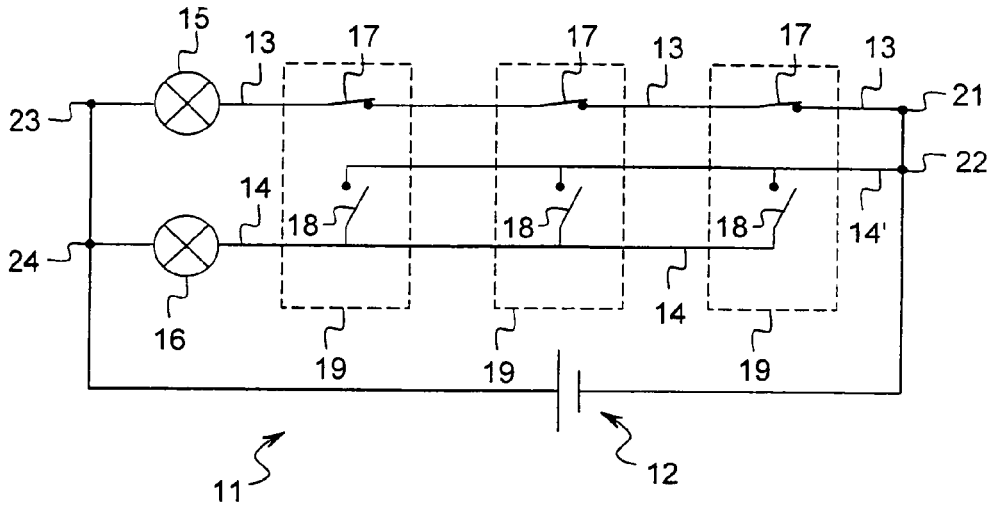
FIG. 1 is a diagram showing a first embodiment of a detection unit and system in accordance with the invention.

With reference to FIG. 1, the system 11 of the invention comprises a battery 12 having connected in parallel across its terminals a monitoring line 13 and a fault line 14, 14'.

A lamp 15, e.g. green in color, is inserted in the line 13, while a second lamp 16, of a different color, e.g. red, is inserted in the line 14.

The line 13 includes three thermal switches or detectors (bimetallic strips) 17 that are normally closed, i.e. that are closed so long as the temperatures of these switches do not exceed their respective transition (opening) temperatures.

The line 14, 14' includes three thermal switches or detectors 18 that are normally open and that remain open so long as their temperatures do not exceed their respective transition temperatures (for closure).

The switches 17 are connected in series while the switches 18 are connected in parallel in the branch 14-14'.

Each of the three cells 19 combines an NC switch 17 and an NO switch 18.

Figure 2:
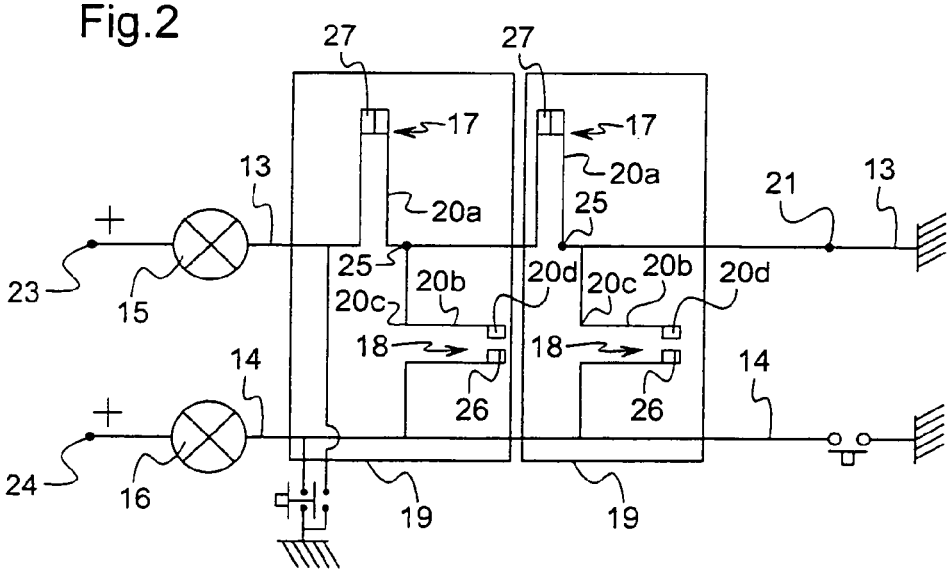
FIG. 2 is a diagram showing a second embodiment of a detection unit and system in accordance with the invention.

The system shown in FIG. 1 and the unit shown in FIG. 3 comprise three cells 19 each, while the unit shown in FIG. 2 has only two.

The cells (three-terminal, four-terminal, or multi-terminal circuits) are connected in cascade.

For each cell, the respective transition temperatures of the switch 17 and of the switch 18 are selected to have values that correspond to the temperature that the zone to be monitored by the cell in question is not to exceed.

In FIGS. 1 and 2, the two transition temperatures are close together, and ideally equal; in FIG. 3, where a single bimetallic strip 20 is common to both switches 17 and 18 of a cell in question, these two temperatures are equal.

So long as no transition temperature has been reached, which corresponds to the configuration in FIGS. 1 to 4 and 6 to 8, the switches 17 remain closed and the switches 18 remain open, so the lamp 15 indicates proper operation while the lamp 16 is off.

When one of these temperatures is reached in a zone monitored by a cell 19, the switch 17 of the cell opens and the switch 18 of the cell closes, thereby causing, substantially simultaneously, the lamp 15 to be turned off and the alarm lamp 16 to be turned on.

The unit shown in FIG. 2 differs from that of FIG. 1 by the fact that a terminal 25 of each switch 18 is connected to a terminal of the switch 17 of the corresponding cell 19, instead of being connected to the potential of the terminal 22 of the two-terminal circuit (22, 24).

With reference to FIGS. 2 to 5 in particular, each detector 17, 18 comprises a bimetallic strip 20, 20*a*, 20*b* secured to a support 60 via its base 20*c* and having its free end 20*d* carrying a contact surface that faces a contact surface 26 or 27 that is stationary; depending on whether the transition temperature has been exceeded (FIG. 5) or not (FIGS. 1 to 4 in particular), the deformation of the strip causes its end 20*d* to be put into contact respectively with the contact surface 26 or with the contact surface 27.

The unit shown in FIG. 3 and the detectors shown in FIGS. 4 to 8 differ from those of FIG. 2 by the fact that only one strip 20 serves to perform either closure of the NC contact 17 or opening of the NO contact 18.

In the embodiment shown in FIGS. 4 to 6 and 8, a conductor element 30 is provided at the end of a rod 31 extending through a wall 32 of a sealed housing 33 containing the strip 20 and the respective contacts 26, 27 of the switches 18, 17.

The rod 31 is used to insert the element 30 between the contact surfaces 20*d* and 26 so as to "artificially" close the NO switch 18 in order to test that the detector 28 is properly connected, i.e. in order to close the switch 18 without subjecting the detector to its transition temperature.

In the embodiment shown in FIGS. 4 and 5, this displacement of the element 30 along the axis 36 is obtained by screwing in or out a screw 34 that is secured to the rod 31 and that passes through a nut 35 secured to the wall 32 of the housing 33.

Figure 6:
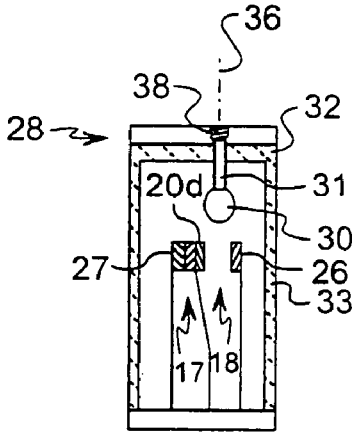
Figure 8:
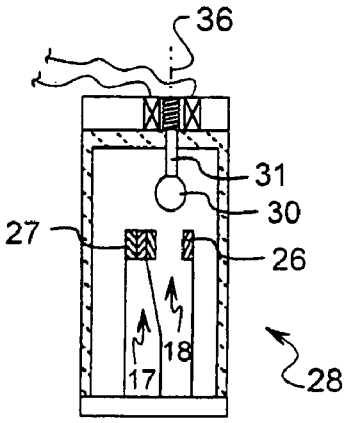
Figure 9:
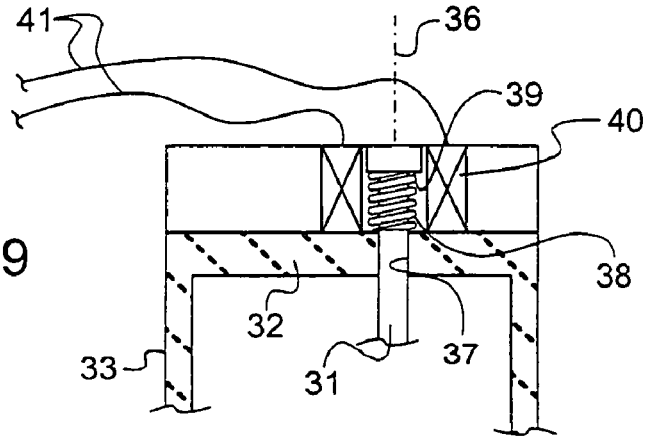

In the embodiments shown in FIGS. 6, 8, and 9, this displacement is obtained by causing the rod 31 to slide in an orifice 37 pierced through the wall 32 along the axis 36. In these embodiments, the rod 31 is urged towards the high position by a helical spring 38 bearing against the wall 32 and a shoulder 39 provided at the top end of the rod 31 so as to extract the element 30 from between the strip and the contact 26.

In the embodiment shown in FIG. 6, the element 30 is inserted by applying a vertical downward force manually on the head of the rod 31, which force needs to be sufficient to flatten the spring 38. In the embodiment shown in FIGS. 8 and 9, this force is obtained by an electromagnetic field created by powering a coil 40 in the airgap from which a portion of the rod 31 extends; for this purpose, the coil 40 is connected by conductor wires 41 to an electrical power supply, not shown.

The element 30 may present roughness that is sufficient to clean the contact surfaces 26, 20*d* of the NO switch 18 by abrasion when the element is inserted between them by means of the rod 31.

Figure 7:
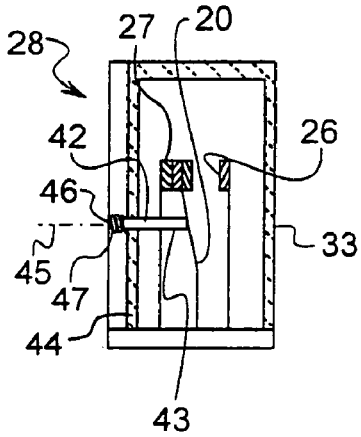

In the embodiment shown in FIG. 7, a rod 42 is mounted to slide along an axis 45 relative to a wall 44 of the housing 33; an inside end 43 of the rod bears against the strip 20, while an outside end of the rod having a shoulder 46 is pushed away from the wall 44 by a spring 47.

By applying sufficient force, from left to right in FIG. 7, to overcome the return force of the spring 47, an operator can deform the strip 20 in the same direction until its free end comes into contact with the contact surface 26, in order to test whether the detector is properly connected to the power supply feeding it.

What is claimed is:

1. A thermal detection and visual alarm unit comprising a plurality of first expansion thermal detectors (17) with normally closed contacts that are connected in series with a first lamp (15) to form a first two-terminal circuit (21, 23), a plurality of second expansion thermal detectors (18) with normally open contacts connected in parallel, a second lamp (16) connected in series with the second thermal detectors to form a second two-terminal circuit (22, 24), the first and second thermal detectors forming a plurality of cells (19) each combining a first detector and a second detector having respective contact-opening or contact-closing temperatures that are substantially equal, each of said first and second two-terminal circuits being arranged for connection to the terminals of an electrical power supply (12).

2. A unit according to claim 1, in which:

each of said cells for detecting transition through a transition temperature comprises a strip or structure suitable for deforming by differential expansion and for switching over, at said transition temperature, from a first position in which a normally closed contact is closed to a second position in which a normally open contact is closed and a normally closed contact is opened, and vice versa; and at least one and preferably each of the cells further includes an electrically conductive element that is movable relative to the deformable strip or structure, together with a member provided for placing the moving conductor element in contact with the deformable strip or structure so as to cause, in said first configuration, the normally open contact to close.

3. A unit according to claim 1, in which at least one of said cells includes an element bearing against a strip or structure that is deformable by expansion, together with a member for causing deformation of said deformable strip or structure by pressing the bearing element thereagainst, the deformation being sufficient to open the normally closed contact and to close the normally open contact.

4. A unit according to claim 2, in which the moving conductor element or bearing element is secured to a support that is mounted to move relative to a substantially sealed housing containing the deformable strip or structure.

5. A unit according to claim 4, in which the moving support is urged by a spring towards a position in which the conductor or bearing element is not active.

6. A unit according to claim 4, in which said moving support is displaced by exciting an electromagnetic circuit.

7. A system (11) for detecting fire on board an aircraft, the system comprising:

an electrical power supply (12); and a plurality of detection cells (19), each cell being provided in a zone to be monitored of the aircraft and comprising a first expansion thermal detector (17) with normally closed contacts together with a second expansion thermal detector (18) with normally open contacts, the respective changeover temperatures of the first and second detectors of a cell being equal or close, the cells being connected in cascade and forming a monitoring equipotential or line (13) and a fault line (14, 14'), a lamp being inserted in each of these two lines, the two lines being connected, in parallel, across the terminals of the electrical power supply.

8. A system according to claim 7, in which:

each of said cells for detecting transition through a transition temperature comprises a strip or structure suitable for deforming by differential expansion and for switching over, at said transition temperature, from a first position in which a normally closed contact is closed to a second position in which a normally open contact is closed and a normally closed contact is opened, and vice versa; and at least one and preferably each of the cells further includes an electrically conductive element that is movable relative to the deformable strip or structure, together with a member provided for placing the moving conductor element in contact with the deformable strip or structure so as to cause, in said first configuration, the normally open contact to close.

9. A system according to claim 7, in which at least one of said cells includes an element bearing against a strip or structure that is deformable by expansion, together with a member for causing deformation of said deformable strip or structure by pressing the bearing element thereagainst, the deformation being sufficient to open the normally closed contact and to close the normally open contact.

10. A system according to claim 8, in which the moving conductor element or bearing element is secured to a support that is mounted to move relative to a substantially sealed housing containing the deformable strip or structure.

11. A system according to claim 10, in which the moving support is urged by a spring towards a position in which the conductor or bearing element is not active.

12. A system according to claim 10, in which said moving support is displaced by exciting an electromagnetic circuit.

* * * * *